US009283772B2

(12) United States Patent
Perez Gellida et al.

(10) Patent No.: US 9,283,772 B2
(45) Date of Patent: Mar. 15, 2016

(54) DRYING ASSEMBLY

(71) Applicant: Hewlett-Packard Development Company, L.P., Houston, TX (US)

(72) Inventors: Francisco Javier Perez Gellida, Sant Cugat del Valles (ES); Mikel Zuza Irurueta, Sant Cugat del Valles (ES); Oriol Borrell Avila, Sant Cugat del Valles (ES); Juan Manuel Valero Navazo, Sant Cugat del Valles (ES); Roger Bastardas Puigoriol, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/414,866

(22) PCT Filed: Sep. 21, 2012

(86) PCT No.: PCT/US2012/056450
§ 371 (c)(1),
(2) Date: Jan. 14, 2015

(87) PCT Pub. No.: WO2014/046665
PCT Pub. Date: Mar. 27, 2014

(65) Prior Publication Data
US 2015/0202896 A1 Jul. 23, 2015

(51) Int. Cl.

| | |
|---|---|
| ***B41J 2/01*** | (2006.01) |
| ***B41J 11/00*** | (2006.01) |
| ***B41F 23/04*** | (2006.01) |
| ***B41J 29/377*** | (2006.01) |

(52) U.S. Cl.
CPC ..... *B41J 11/0015* (2013.01); *B41F 23/04* (2013.01); *B41J 11/002* (2013.01); *B41J 29/377* (2013.01)

(58) Field of Classification Search
USPC ..... 347/5, 9, 14, 17, 102
See application file for complete search history.

(56) References Cited

U.S. PATENT DOCUMENTS

| | | | |
|---|---|---|---|
| 5,406,316 | A | 4/1995 | Schwiebert et al. |
| 6,463,674 | B1 | 10/2002 | Meyers et al. |
| 7,317,467 | B2 | 1/2008 | Shepherd et al. |
| 2004/0109054 | A1 | 6/2004 | Martin et al. |
| 2005/0088475 | A1 | 4/2005 | Medin |
| 2006/0083535 | A1 | 4/2006 | Shepherd et al. |

(Continued)

FOREIGN PATENT DOCUMENTS

| | | |
|---|---|---|
| CN | 102241192 | 11/2011 |
| JP | 2006187920 | 7/2006 |

(Continued)

OTHER PUBLICATIONS

International Searching Authority, "International Search Report and Written Opinion", issued in connection with PCT Application Serial No. PCT/US2012/056450, mailed Apr. 29, 2013, 10 pages.
"NZXT Sentry 2 LCD Touch Screen Fan Controller", [http://www.overclockers.co.uk/showproduct.php?prodid=BB-001-NX], accessed on Jan. 12, 2015, 2 pages.

*Primary Examiner* — Lam Nguyen
(74) *Attorney, Agent, or Firm* — HP Inc. Patent Department

(57) ABSTRACT

A drying assembly is disclosed. The drying assembly has at least 2 fan units where each fan unit has a fan. The fan speed of each fan is adjusted independently to control the air temperature from the fan. The airflow through all of the fans is maintained at a constant value.

18 Claims, 6 Drawing Sheets

(56) References Cited

U.S. PATENT DOCUMENTS

2011/0267393 A1* 11/2011 Okamoto ..... 347/14
2012/0162304 A1 6/2012 Fujikura

FOREIGN PATENT DOCUMENTS

JP 2011056699 3/2011
WO 2010122121 10/2010

* cited by examiner

DRYING ASSEMBLY

BACKGROUND

Many printers use liquid inks to print images onto media. Some of the liquid inks need to be evenly cured across the page to ensure proper durability and even gloss in the printed output.

DETAILED DESCRIPTION

Figure 1:
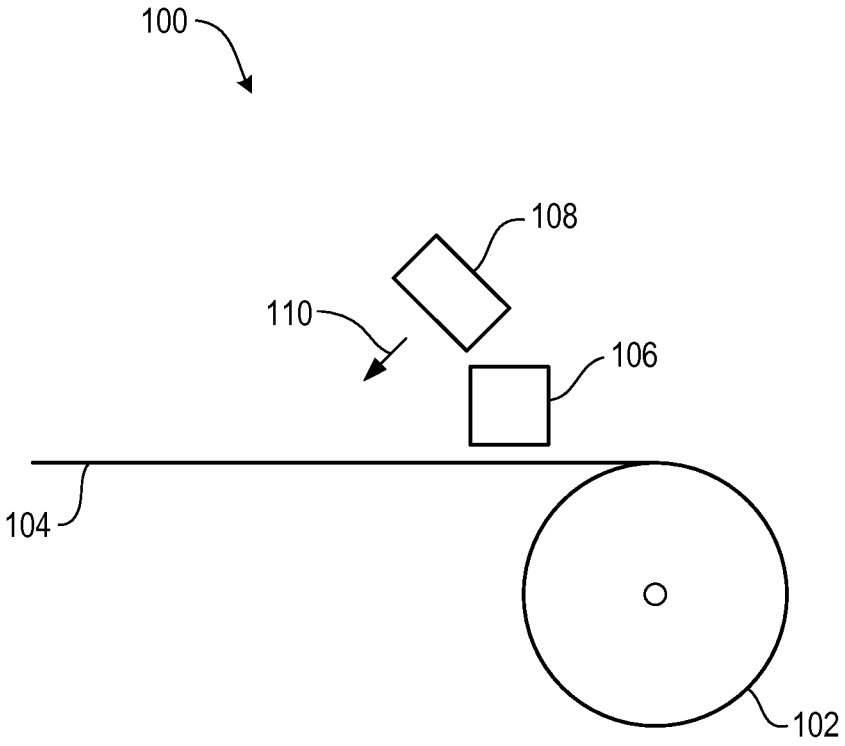
FIG. 1 is a side view of an example printer 100.

FIG. 1 is a side view of an example printer 100. The printer comprises media supply system 102, media 104, inkjet print bar 106 and drying assembly 108. In this example media 104 is a continuous sheet supplied by media supply system 102. In other examples media may comprise individual sheets. Media 104 is fed from media supply system 102 underneath print bar 106. Inkjet heads on print bar 106 deposit ink onto media 104. In other example printers, there may be an intermediate transfer blanket that receives ink from the inkjet heads and transfers the ink to the media. Once the ink has been deposited onto the media, the media passes underneath the drying assembly 108. Drying assembly 108 forces heated air past media 104 as shown by arrow 110. The heated air dries and cures the ink deposited onto the media. Print bar 106 may also deposit additional compounds onto media, for example gloss coats and the like.

Figure 2A:
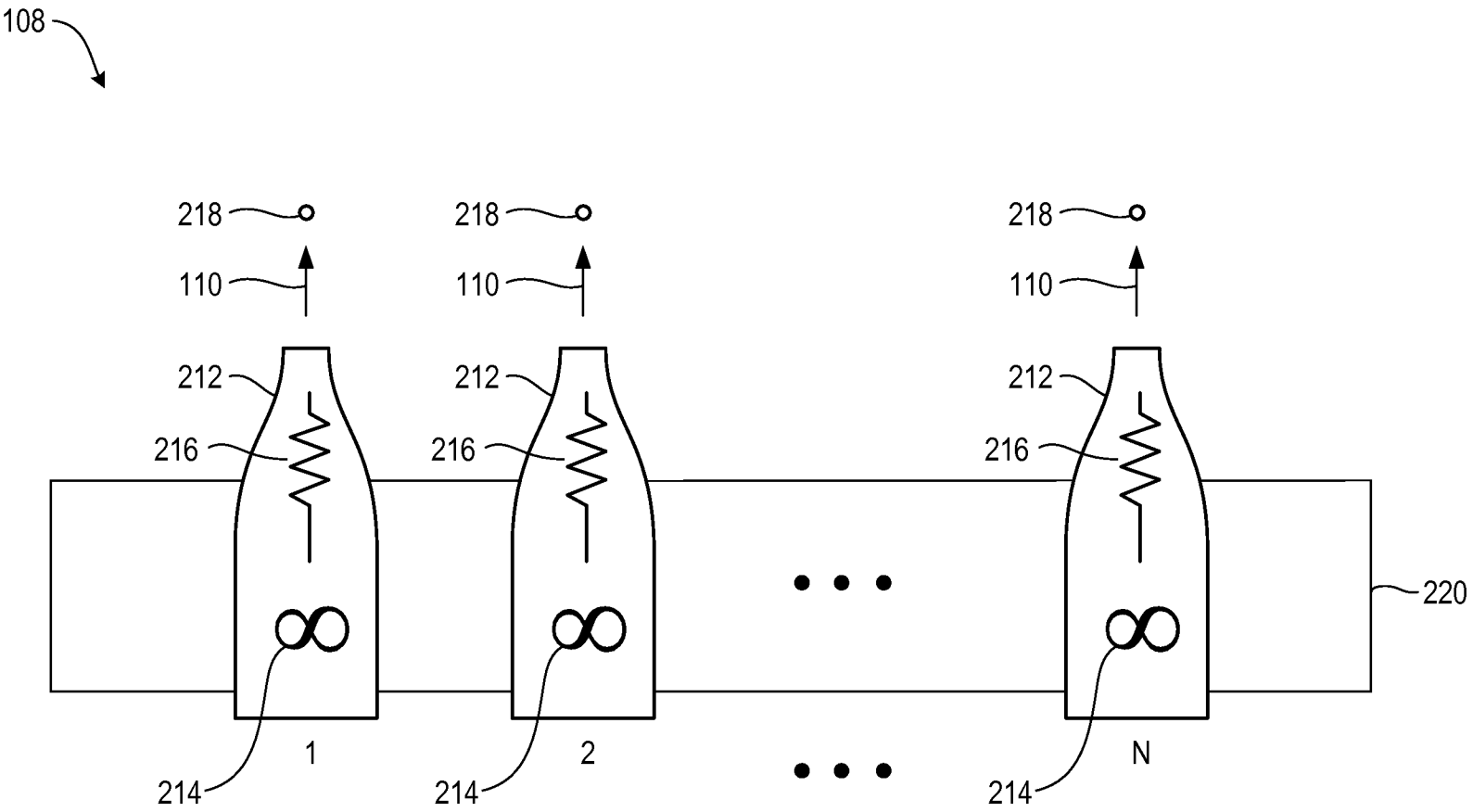
FIG. 2A is block diagram of an example drying assembly 108.

FIG. 2A is a block diagram of drying assembly 108. Drying assembly comprises N fan units, where N is an integer greater than 1. Each fan unit comprises a fan housing 212, a fan 214, a heating element 216 and a temperature sensor 218. The fan units are attached to support 220 in a spaced apart relationship. Each fan 214 is located inside a fan housing 212 and forces air in the direction shown by arrow 110. The heating elements 216 may also be located inside the fan housings 212. The heating elements 216 heat the air moved by the fans 214. The temperature sensors 218 are located near the fan exhaust and can monitor the temperature of the air as it leaves each fan housing 212.

Figure 2B:
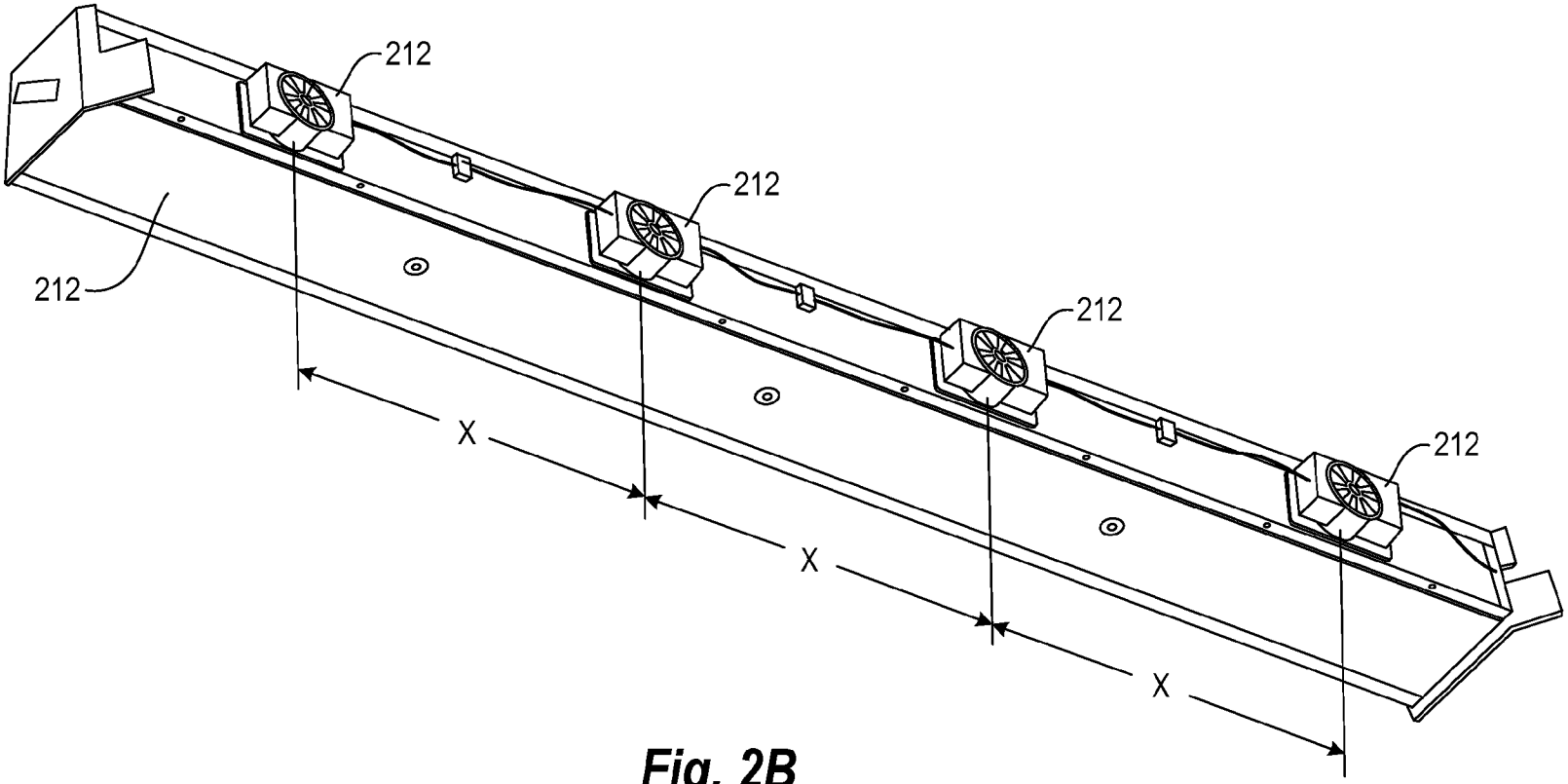
FIG. 2B is an isometric view of an example drying assembly 108.

FIG. 2B is an isometric view of drying assembly 108. In this example there are 4 fan units spaced along support 220. The fan units are spaced apart by distance X, where distance X is 425.6 mm. In other examples there may be a different number of fan units, for example three fan units spaced apart by 487 mm.

The speed of each fan can be controlled independently. The fan speeds are adjusted with a fan speed control signal, typically a pulse width modulation (PWM) signal. The temperatures of the heating elements are controlled with a heating element control signal. In one example a single heating element control signal is used for all of the heating elements. Typically each of the N heating elements may have some resistance variability. In addition each of the N fans may run at a slightly different speed given the same input signal. Due to these variations, the air temperature exiting each fan may be different even with the same input control signals (i.e. the fan speed control signal and the heating element control signal). The variation in air temperature can cause uneven curing and drying across the page.

In one example, a controller reads each temperature sensor to determine the air temperature at each fan exhaust. The controller adjusts the speed of each fan based on the air temperature to maintain the same air temperature at each fan exhaust. The controller also maintains the total air flow through all the fans as a constant value. One way to keep the total airflow constant is to keep the sum of the PWM from all of the fans at a constant value. In one example, all the heating elements will be coupled together and controlled using a single heating element control signal. Using this method the temperature uniformity across the page can be maintained and de-coupled with the power control of the heating elements.

Figure 3:
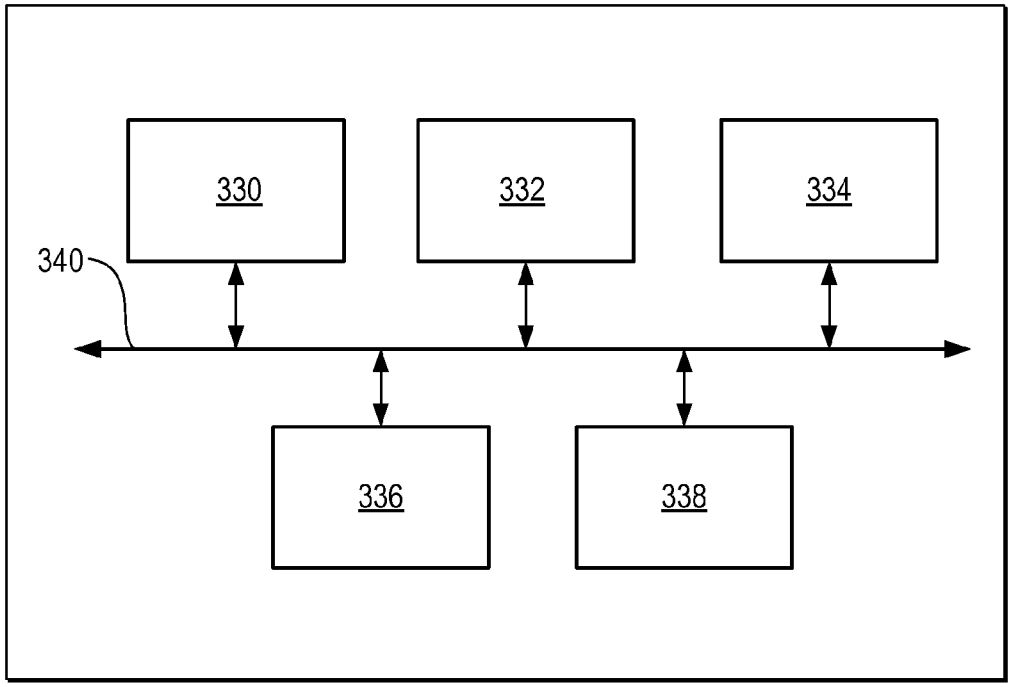
FIG. 3 is a block diagram of an example printer.

FIG. 3 is a block diagram of an example printer. Printer comprises a processor 330, memory 332, input/output (I/O) module 334, print engine 336 and controller 338 all coupled together on bus 340. In some examples printer may also have a display, a user interface module, an input device, and the like, but these items are not shown for clarity. Processor 330 may comprise a central processing unit (CPU), a micro-processor, an application specific integrated circuit (ASIC), or a combination of these devices. Memory 332 may comprise volatile memory, non-volatile memory, and a storage device. Memory 332 is a non-transitory computer readable medium. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

I/O module 334 is used to couple printer to other devices, for example the Internet or a computer. Print engine 336 may comprise a media supply system, a printhead, a drying assembly, an ink supply system, and the like. Printer has code, typically called firmware, stored in the memory 332. The firmware is stored as computer readable instructions in the non-transitory computer readable medium (i.e. the memory 332). Processor 330 generally retrieves and executes the instructions stored in the non-transitory computer-readable medium to operate the printer. In one example, processor executes code that directs controller 338 to control a drying assembly in the print engine 336.

Figure 4:
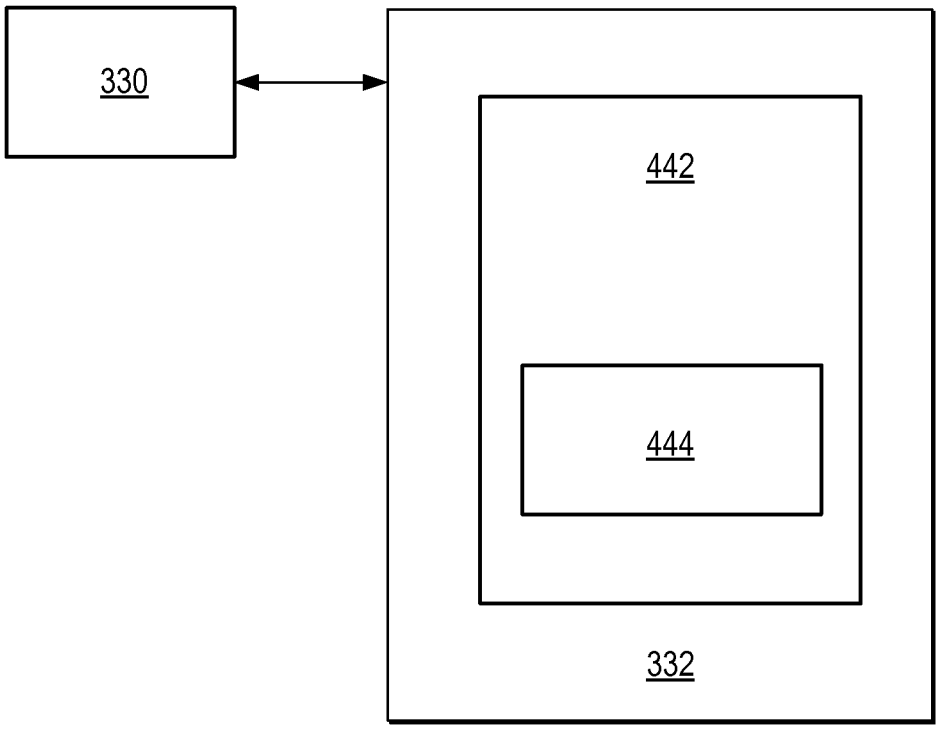
FIG. 4 is an example block diagram of the processor 330 coupled to memory 332.

FIG. 4 is an example block diagram of the processor 330 coupled to memory 332. Memory 332 contains firmware 442. Firmware 442 contains a drying module 444. The processor 330 executes the code in drying module 444 to direct controller 338 to control the drying assembly 108.

Controller 338 is used to control the drying assembly 108. Drying assembly 108 heats the ink, media and any other components deposited on the media. The ink is heated to above a predetermined temperature threshold to ensure proper curing. The ink is also heated uniformly across the width of the media. In some examples two controllers may be used, one controller to control the fan speeds and thereby control the temperature uniformity across the page, and one controller to control the power to the heating elements thereby controlling the average temperature of the air leaving the drying assembly. In other examples one controller will be used to control both the fan speed and the heating elements.

The single controller will still control the two systems independently.

The controller adjusts the power to the heating elements and the speed of the fans to ensure that the ink reaches the threshold temperature evenly across the media. In one example, all of the N heating elements are coupled together and receive the same power setting. The controller adjusts the power setting to the N heating elements to control the average temperature of the air leaving the drying assembly 108. The controller can adjust the speed of each of the N fans 214 independently. The controller adjusts the fan speed of individual fans to maintain a uniform temperature across the width of the media while keeping the sum of the air flow through all the fans constant. One way to keep the total airflow constant is to keep the sum of the PWM from all of the fans at a constant value.

Figure 5:
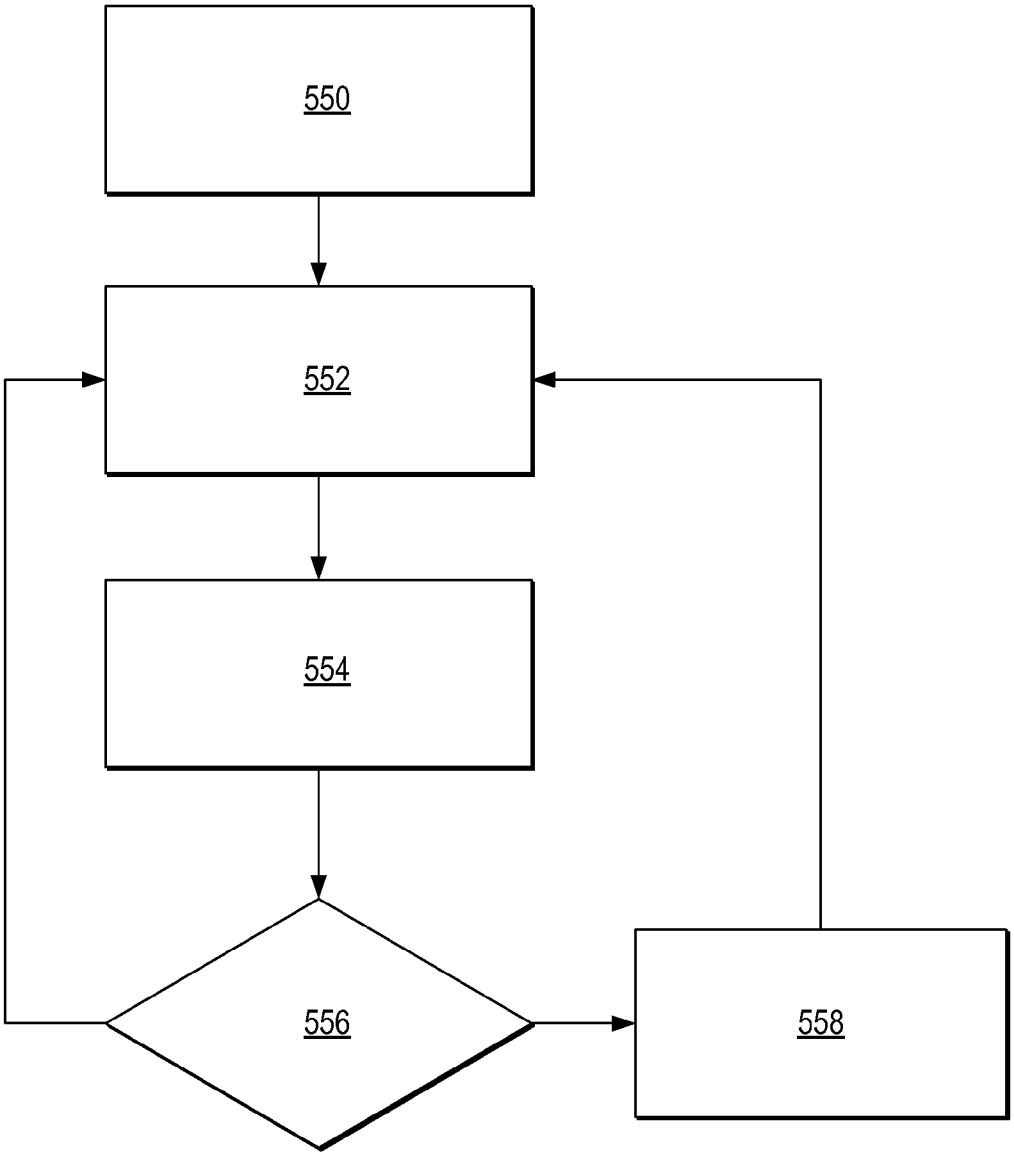
FIG. 5 is a flow chart for an example method for controlling the fans in a drying assembly.

FIG. 5 is a flow chart for an example method for controlling the fans in a drying assembly. The fan speed control method starts at step 550 where the startup parameters are set. The startup parameters include the initial fan speed control signal for each of the N fans. The startup parameters may include a delay time to allow the fans to get up to speed before entering the fan speed control loop. Concurrently with the start of the fan speed control method, a temperature control method is also started. The temperature control method is used to keep the average temperature exiting the fans at a given value.

After block 550 the fan speed control method proceeds to block 552. Block 552 is the start of the fan speed control loop. At block 552 the air temperature near the exhausts of each of the N fans is determined by reading the temperature sensors for each fan unit. At block 554 the average air temperature is calculated as well as a delta temperature at each fan unit. The delta temperature for each fan unit is the average air temperature minus the air temperature at that fan unit. In one example, at block 556 the delta air temperature for each fan unit is compared to a threshold value. When all of the delta temperatures are below the threshold value the temperature uniformity across the fan units is within a predetermined range. Therefore flow returns to block 552.

When the delta temperature of any of the fan units is above the threshold value, flow continues at block 558. In another example, the delta air temperature for each fan unit is not compared to a threshold value, flow automatically proceeds from block 554 to block 558. At block 558 new fan speeds are calculated for each fan unit. A negative delta temperature for a fan unit means the air temperature at that fan unit is higher than the average air temperature. A positive delta temperature for a fan unit means the air temperature at that fan unit is lower than the average air temperature. The fan speeds for fans with air temperature higher than the average air temperature (i.e. a negative delta temperature) are increased. The fan speeds for fans with air temperature lower than the average air temperature (i.e. a positive delta temperature) are decreased.

The sum of the airflow through all the fans is kept at a constant value. One way to keep the total airflow constant is to keep the sum of the PWM from all of the fans set to a predetermined value. For example, when there are 4 fans, the sum of the PWM signals from each fan will be set equal to a predetermined value (predetermined value=PWM1+PWM2+PWM3+PWM4). When the predetermined value is 200% the PWM's for the 4 fans may be 50%, 45%, 53% and 52% respectively. The predetermined value may be changed by the servo that controls the absolute pressure in the chamber. Once the new fan speeds are calculated the fan speed control signals are updated with the new values. Flow then returns to block 552.

The fan speed control signal is typically a pulse width modulation (PWM) signal. In one example, equation 1 is used to determine the new fan speed control signal at block 558.

$$PWM_i(t+\Delta t)=PWM_i(t)+K_{int}*err_int_i(t+\Delta t) \quad \text{Equation 1}$$

Where $PWM_i(t+\Delta t)$ is the new fan speed control signal at time t plus delta time ($\Delta t$) for the $i^{th}$ fan unit, $PWM_i(t)$ is the old fan speed control signal at time t for the $i^{th}$ fan unit, $K_{int}$ is the gain for the interval delta time, and err_int_i(t+Δt) is the error signal for the $i^{th}$ fan unit for the interval delta time. Delta t ($\Delta t$) may be in the range between 0.1 second through 40 seconds, for example 1 second.

In one example, $K_{int}$ is calculated using equation 2.

$$K_{int}=0.04\%\ PWM/C \quad \text{Equation 2}$$

Where % PWM/C is the relationship between the % PWM signal and the temperature (Celsius). In other examples $K_{int}$=may be set in the range between 0.5% PWM/C through 0.001% PWM/C.

In one example err_int_i(t+Δt) is determined using equation 3.

$$err_int_i(t+\Delta t)=1/\Delta t\int_t^{t+\Delta t}(T_i-T_{ave})dt[=]C \quad \text{Equation 3}$$

where $T_i$ and $T_{ave}$ are the air temperature at the $i^{th}$ fan unit and the average air temperature respectively. By definition the sum of the error signals for all of the fan units is equal to zero. This maintains a total constant airflow across all the fan units.

In another example a derivative term is added to equation 1 to improve the stability of the servo loop. The derivative takes into account the relative slope of the temperature ($T_i$) vs. time (t) curve at each fan unit compared to the average temperature ($T_{ave}$) vs. time (t) curve. Equation 1 becomes equation 4.

$$PWM_i(t+\Delta t)=PWM_i(t)+K_{int}*err_int_i(t+\Delta t)+K_d*err_der_i(t+\Delta t) \quad \text{Equation 4}$$

Where $K_d$=0.6% PWM/(C/sec) and err_der_i(t+Δt) is defined in equation 5.

$$err_der_i(t+\Delta t)=1/\Delta t\int_t^{t+\Delta t}(\dot{T}_i-\dot{T}_{ave})dt[=]C/s \quad \text{Equation 5}$$

Where $\dot{T}_i$ and $\dot{T}_{ave}$ are the slope of the temperature vs. time curve for the $i^{th}$ fan unit and the temperature vs. time curve for the average temperature, respectively.

The thermal gain of the system is defined as the change in air temperature for a given change in the PWM percent (C/PWM %). In some examples the thermal gain is between 4 and 15 degrees C. for a change of one percent in the PWM duty cycle, for example 6.67 C/PWM %. Because of this thermal gain, small changes in the fan speed control signal can cause large changes in air temperature. During operation a typical range for the fan speed control signal is between 40%-90% PWM.

The change in air speed/pressure for a given change in PWM % in the average fans speed control signal is dependent on the number of fan units, the fan type, the absolute PWM of the fan speed control signal and the fan outlet/exhaust geometry. In one example for a drying assembly with three fan units, at an absolute fan speed control signal of 83% PWM (in all 3 fans) results in 2.3 $m^3$/min (or a 4.6 $mmH_2O$ pressure). For the same system, at an absolute fan speed control signal of 73% PWM (in all 3 fans) results in 2.0 $m^3$/min (or a 3.8 $mmH_2O$ pressure). Therefore the Pressure gain is (4.6-3.8)/10=0.08 $mmH_2O$/PWM % and the Airflow Gain is (2.3-2.0)/10=0.03 (m^3/min)/PWM %. During operation a typical air speed at the fan exhaust is between 5-20 m/sec.

What is claimed is:

1. A printer, comprising:

fan units to force air onto media during a printing operation, each of the fan units including:

a fan;

a heater to heat air moved by the fan; and a temperature sensor positioned near an exhaust of the fan unit; and a controller to, in response to temperature values obtained from the temperature sensors, at least one of (1) dynamically adjust at least one of the fans or (2) dynamically adjust at least one of the heaters to maintain a substantially uniform temperature across a width of the media during the printing operation and to maintain a sum of air flow exiting the fans to be at a substantially constant value.

2. The printer of claim 1, wherein the heaters of the fan units are coupled together and controlled with a single heating element control signal.

3. The printer of claim 1, wherein the controller includes a plurality of controllers.

4. The printer of claim 1, wherein the printing operation includes depositing printing fluid onto the media.

5. A printer, comprising:

a number N of fan units directed to force air to a drying zone, where N is an integer 2 or greater and each fan unit includes:

a fan;

a heating element positioned to heat air moved by the fan; and a temperature sensor positioned near an exhaust of the fan unit;

a controller coupled to each fan unit, the controller to monitor the temperature sensor in each fan unit, the controller to independently adjust a speed of each fan to maintain a same temperature at all N fan units, the controller to keep a total airflow through all N fan units at a constant value, wherein the speed of each fan is independently adjustable using a fan speed control signal, where each fan speed control signal is a pulse width modulation (PWM) signal, and wherein an adjusted fan speed control signal for each fan is equal to $PWM_N(t)+K_{int}*err_int_N(t+\Delta t)$, wherein $PWM_N(t)$ is a fan speed control signal at time t for the $N^{th}$ fan unit, $K_{int}$ is a gain for the interval delta time ($\Delta t$), and $err_int_N(t+\Delta t)$ is an error signal for the $N^{th}$ fan unit for the interval delta time ($\Delta t$).

6. The printer of claim 5, wherein the adjusted fan speed control signal for each fan includes the term $K_d*err_der_N(t+\Delta t)$, where $K_d$ is a gain and $err_der_N(t+\Delta t)$ is an error signal for the $N^{th}$ fan unit for the interval delta time ($\Delta t$) that is based on a relative slope of the temperature ($T_N$) vs. time (t) curve for the $N^{th}$ fan unit compared to an average temperature ($T_{ave}$) vs. time (t) curve.

7. The printer of claim 5, wherein the delta time ($\Delta t$) is in the range from 0.1 second to 40 seconds.

8. A printer, comprising:

a number N of fan units directed to force air to a drying zone, where N is an integer 2 or greater and each fan unit includes:

a fan;

a heating element positioned to heat air moved by the fan; and a temperature sensor positioned near an exhaust of the fan unit;

a controller coupled to each fan unit, the controller to monitor the temperature sensor in each fan unit, the controller to independently adjust a speed of each fan to maintain a same temperature at all N fan units, the controller to keep a total airflow through all N fan units at a constant value, the controller to determine an average temperature for all of the fans; the controller to determine a delta temperature for each fan where the delta temperature equals the average temperature minus a temperature at each fan; the controller to maintain a same fan speed for each of the fans when the delta temperature for all of the fans is below a threshold.

9. The printer of claim 8, wherein N is in a range from about 3 to 8 fan units.

10. The printer of claim 8, further including a support, wherein the fan units are spaced along the support by distance X, where distance X is in a range from 30 mm to 800 mm.

11. A method of controlling a drying assembly, comprising forcing air onto media during a printing operation using fan units of a printer, the fan units respectively including a fan, a heater, and a temperature sensor;

obtaining temperature values from the temperature sensors, the temperature values representing a temperature of air exiting the fan units; and dynamically adjusting at least one of (1) at least one of the fans or (2) at least one of the heaters to maintain a substantially uniform temperature across a width of the media during the printing operation and to maintain a sum of air flow exiting the fans to be at a substantially constant value.

12. The method of claim 11, wherein the printing operation includes depositing printing fluid onto the media.

13. A method of controlling a drying assembly, comprising determining a temperature of air leaving each of N fan units where N is an integer greater than one;

calculating an average air temperature for all N fans;

decreasing a fan speed for each fan with air temperatures lower than the average air temperature;

increasing the fan speed for each fan with an air temperature higher than the average air temperature;

maintaining a sum of the airflow through all N fans at a constant value, wherein the fan speed is controlled using a pulse width modulation (PWM) signal, and adjusted fan speed control signal for each fan is equal to $PWM_N(t)+K_{int}*err_int_N(t+\Delta t)$, where $PWM_N(t)$ is a fan speed control signal at time t for the $N^{th}$ fan unit, $K_{int}$ is a gain for the interval delta time ($\Delta t$), and $err_int_N(t+\Delta t)$ is an error signal for the $N^{th}$ fan unit for the interval delta time ($\Delta t$).

14. The method of claim 13, further including dynamically adjusting heaters of the respective fan units including sending a single servo control signal.

15. The method of claim 14, further including increasing or decreasing a fan speed for each fan within a threshold time period.

16. The method of claim 14, wherein the printer includes 3 or 4 fan units.

17. The method of claim 13, wherein the adjusted fan speed control signal for each fan includes the term $K_d*err_der_N(t+\Delta t)$, where $K_d$ is a gain and $err_der_N(t+\Delta t)$ is an error signal for the $N^{th}$ fan unit for the interval delta time ($\Delta t$) that is based on a relative slope of the temperature ($T_N$) vs. time (t) curve for the $N^{th}$ fan unit compared to an average temperature ($T_{ave}$) vs. time (t) curve.

18. The method of claim 13, wherein the sum of all of the PWM control signals for each fan is maintained at a threshold value.

* * * * *